US006660977B2

(12) United States Patent
Chen

(10) Patent No.: US 6,660,977 B2
(45) Date of Patent: Dec. 9, 2003

(54) ELECTRICAL HEATING PLATE STRUCTURE

(76) Inventor: Shu-Lien Chen, P.O. Box 55-124, Taichung (TW)

( * ) Notice: Subject to any disclaimer, the term of this patent is extended or adjusted under 35 U.S.C. 154(b) by 0 days.

(21) Appl. No.: 10/095,046

(22) Filed: Mar. 12, 2002

(65) Prior Publication Data

US 2003/0173354 A1 Sep. 18, 2003

(51) Int. Cl.[7] ..... H05B 3/16; H05B 3/02
(52) U.S. Cl. ..... 219/543; 219/539
(58) Field of Search ..... 219/539, 543, 219/544, 546, 548, 203, 465.1, 466.1; 338/283, 284, 287, 307, 308, 309

(56) References Cited

U.S. PATENT DOCUMENTS 3,694,627 A * 9/1972 Blatchford et al. ..... 219/543
5,068,517 A * 11/1991 Tsuyuki et al. ..... 219/543
5,218,334 A * 6/1993 Bartlett ..... 338/61
5,264,681 A * 11/1993 Nozaki et al. ..... 219/544
5,644,676 A * 7/1997 Blomberg et al. ..... 392/407

* cited by examiner

*Primary Examiner*—Sang Y. Paik

(57) ABSTRACT

The present invention is to provide an electrical heating plate structure, including an insulating plate, and an electrically conducting plate mounted on the insulating plate. The electrically conducting plate includes multiple heat emitting sections. Each of the heat emitting sections has different radial widths, so that each of the heat emitting sections has radial cross-sectional areas different from each other, thereby capable of controlling a temperature distribution of each region of the electrical heating plate structure.

8 Claims, 5 Drawing Sheets

ELECTRICAL HEATING PLATE STRUCTURE

BACKGROUND OF THE INVENTION

1. Field of the Invention

The present invention relates to an electrical heating plate structure, and more particularly to an electrical heating plate structure including an electrically conducting plate having multiple heat emitting sections, wherein radial cross-sectional areas of each of the multiple heat emitting sections are different from each other, thereby capable of controlling a temperature distribution of each region of the electrical heating plate structure.

2. Description of the Related Art

A first conventional thin-plate type electrical heating plate 1 in accordance with the prior art shown in FIG. 1 comprises an insulating plate 2, and a continuous winding circuit 3 mounted on the insulating plate 2. The circuit 3 is made of metallic material such as copper having a determined resistance, so that when the current passes through the circuit 3, a heat energy may be produced by the resistance of the metallic material of the circuit 3. Thus, the conventional thin-plate type electrical heating plate 1 may function as a heating source which may provide a heat energy to evaporate the water and remove the moist or mist deposited on a surface such as the windshield window of the car.

In general, each section of the circuit 3 has a constant cross-sectional area, thereby producing a constant heat energy. However, the heat transfer effect of the central region of the circuit 3 is smaller than that of the peripheral region of the circuit 3, whereby the heat adjacent to the central region of the circuit 3 is easily accumulated, so that the instantaneous temperature of the central region of the circuit 3 is much greater than that of the peripheral region of the circuit 3, thereby forming difference of temperature on the surface of the electrical heating plate 1. Thus, when the electrical heating plate 1 is applied on the surface of the windshield window of the car, the windshield window easily produces a crack due to the difference of temperature on the surface of the electrical heating plate 1, thereby greatly decreasing the utility of the conventional thin-plate type electrical heating plate 1.

A second conventional thin-plate type electrical heating plate 1A in accordance with the prior art shown in FIG. 2 comprises a serially arranged circuit 3A. Similarly, each section of the circuit 3A has a constant cross-sectional area, thereby producing a constant heat energy.

A third conventional thin-plate type electrical heating plate 1B in accordance with the prior art shown in FIG. 3 comprises a parallel arranged circuit 3B. Similarly, each section of the circuit 3B has a constant cross-sectional area, thereby producing a constant heat energy.

The closest prior art of which the applicant is aware is disclosed in U.S. Pat. No. 5,928,549 to Hitzigrath, entitled "ETCHED FOIL HEATER FOR LOW VOLTAGE APPLICATIONS REQUIRING UNIFORM HEATING".

SUMMARY OF THE INVENTION

The present invention has arisen to mitigate and/or obviate the disadvantage of the conventional electrical heating plate.

The primary objective of the present invention is to provide an electrical heating plate structure including an electrically conducting plate having multiple heat emitting sections, wherein the radial cross-sectional areas of each of the multiple heat emitting sections are different from each other, thereby capable of controlling a temperature distribution of each region of the electrical heating plate structure.

In accordance with the present invention, there is provided an electrical heating plate structure, comprising:

an insulating plate; and at least one electrically conducting plate mounted on the insulating plate;

wherein, the at least one electrically conducting plate includes at least two heat emitting sections, each of the at least two heat emitting sections has different radial widths, so that each of the at least two heat emitting sections has radial cross-sectional areas different from each other, thereby capable of controlling a temperature distribution of each region of the electrical heating plate structure.

Preferably, each of the multiple heat emitting sections has a radial width that is gradually increased from two ends of the heat emitting section toward a mediate portion of the heat emitting section.

Preferably, the radial width of the mediate portion of each of the heat emitting sections is gradually increased from two sides of the insulating plate toward a central portion of the insulating plate, so that each region of the insulating plate has an uniform temperature distribution.

Preferably, two sides of each of the heat emitting sections are formed with symmetric arcuate shapes.

Preferably, the electrical heating plate structure comprises a plurality of independent electrically conducting plates mounted on the insulating plate, thereby providing a large heating area.

Preferably, the radial width of each of the heat emitting sections is gradually increased and gradually decreased in a staggered manner, so that each of the two heat emitting sections may have a symmetric corrugated shape, and wider zones of each of the heat emitting sections may produce a heat smaller than that produced by narrower zones of each of the two heat emitting sections.

Preferably, the heat emitting sections are in parallel with each other, and are connected with each other in a serial manner.

Preferably, the heat emitting sections are in parallel with each other, and are connected with each other in a parallel manner.

Preferably, the heat emitting sections are connected by connecting sections.

Further benefits and advantages of the present invention will become apparent after a careful reading of the detailed description with appropriate reference to the accompanying drawings.

DETAILED DESCRIPTION OF THE INVENTION

Figure 1:
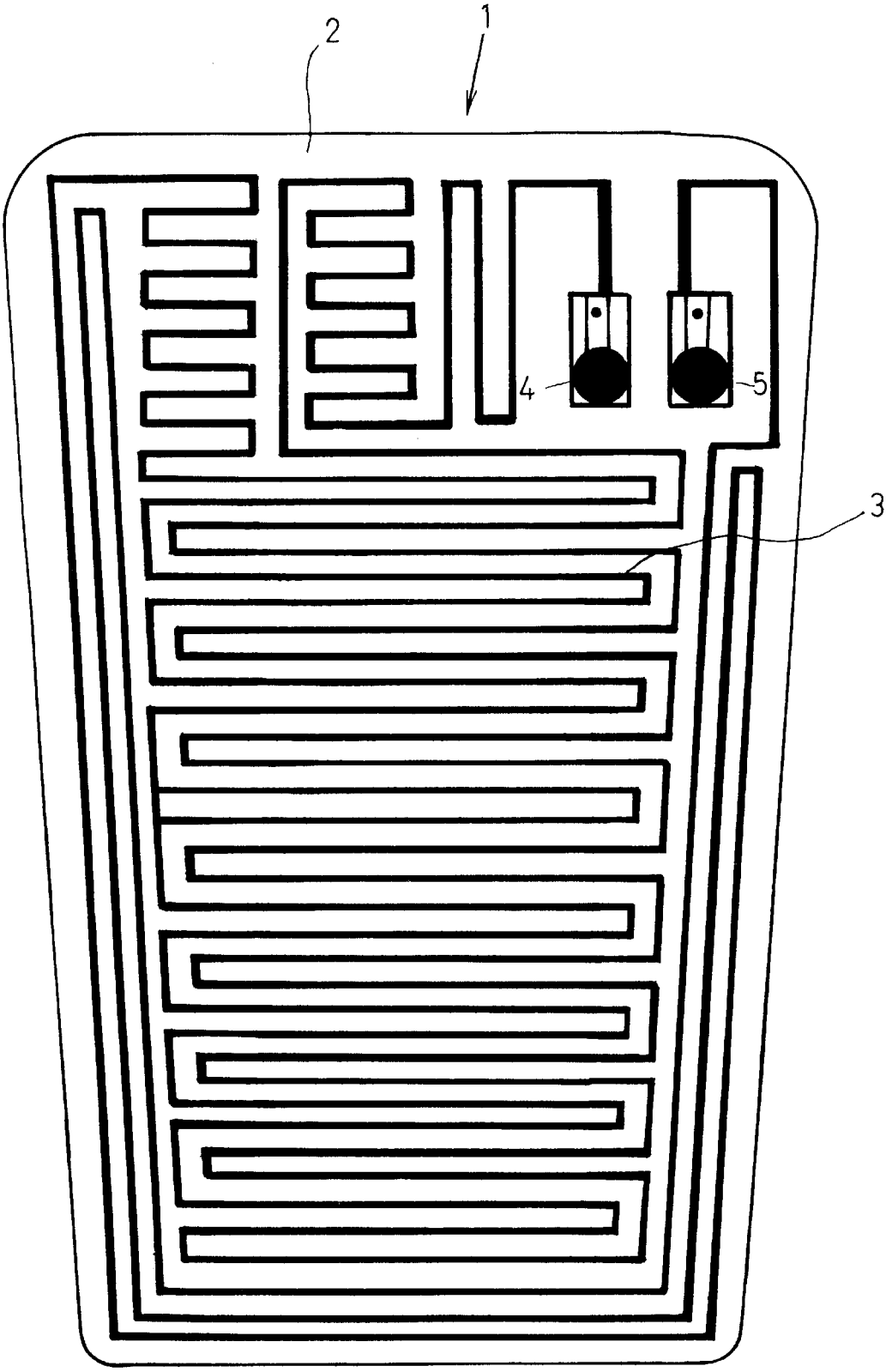
FIG. 1 PRIOR ART
FIG. 1 is a top plan view of a first conventional thin-plate type electrical heating plate in accordance with the prior art.
Figure 2:
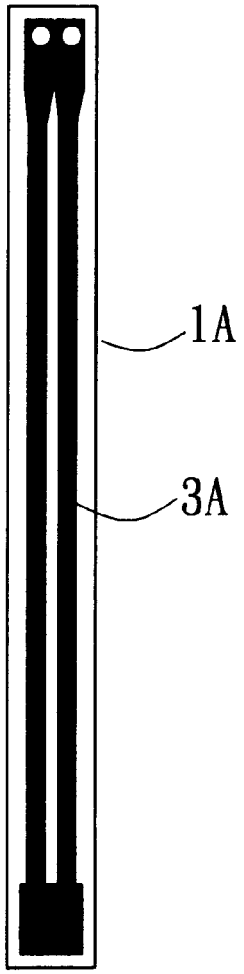
FIG. 2 PRIOR ART
FIG. 2 is a top plan view of a second conventional thin-plate type electrical heating plate in accordance with the prior art.
Figure 3:
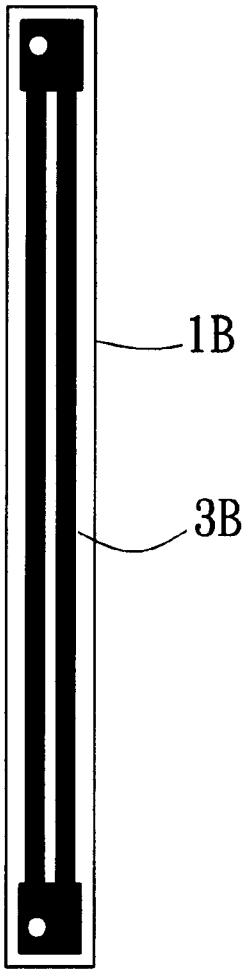
FIG. 3 PRIOR ART
FIG. 3 is a top plan view of a third conventional thin-plate type electrical heating plate in accordance with the prior art.
Figure 4:
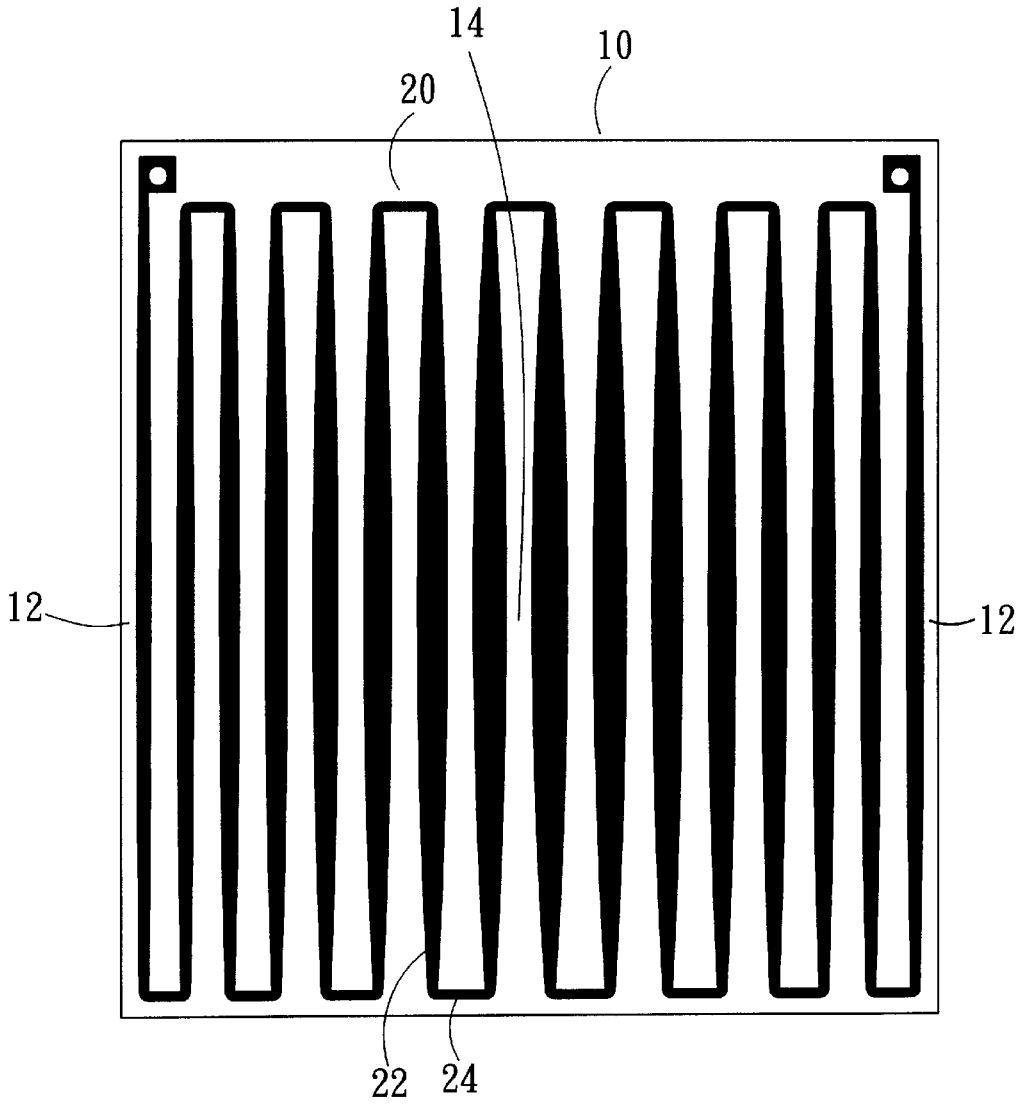
FIG. 4 is a top plan view of an electrical heating plate structure in accordance with a first embodiment of the present invention.

Referring to the drawings and initially to FIG. 4, an electrical heating plate structure in accordance with a first embodiment of the present invention comprises an insulating plate 10, and an electrically conducting plate 20 mounted on the insulating plate 10.

The electrically conducting plate 20 is a continuous elongated plate made of a metallic material having an uniform thickness, and is bonded on the surface of the insulating plate 10 in a winding manner. The electrically conducting plate 20 has two ends which allow a current to pass through the electrically conducting plate 20, thereby producing a heat due to the resistance of the electrically conducting plate 20.

The electrically conducting plate 20 includes multiple heat emitting sections 22, and multiple connecting sections 24 connected between the multiple heat emitting sections 22. The multiple heat emitting sections 22 are in parallel with each other. Each of the multiple heat emitting sections 22 has two ends connected to the adjacent heat emitting section 22 by the connecting sections 24. Each of the multiple heat emitting sections 22 has a radial width that is gradually increased from the two ends of the heat emitting section 22 toward the mediate portion of the heat emitting section 22, so that two sides of the heat emitting section 22 are formed with symmetric arcuate shapes.

The radial width of the mediate portion of each of the heat emitting sections 22 is gradually increased from the two sides 12 of the insulating plate 10 toward the central portion 14 of the insulating plate 10, so that each region of the insulating plate 10 has an uniform temperature distribution.

Accordingly, in accordance with a first embodiment of the present invention, the radial width of each of the multiple heat emitting sections 22 is gradually increased from the two ends of the heat emitting section 22 toward the mediate portion of the heat emitting section 22, and the radial width of the mediate portion of each of the heat emitting sections 22 is gradually increased from the two sides 12 of the insulating plate 10 toward the central portion 14 of the insulating plate 10, so that the radial cross-sectional area of each of the multiple heat emitting sections 22 is different from each other.

Thus, when the current is introduced into the electrically conducting plate 20, each of the multiple heat emitting sections 22 will produce a different heat due to the different resistance, wherein the produced heat of each of the multiple heat emitting sections 22 is gradually decreased from the two ends of the heat emitting section 22 toward the mediate portion of the heat emitting section 22, and the produced heat of the mediate portion of each of the heat emitting sections 22 is gradually decreased from the two sides 12 of the insulating plate 10 toward the central portion 14 of the insulating plate 10, so that each region of the surface of the insulating plate 10 may obtain an uniform temperature distribution, thereby capable of controlling the temperature distribution of the electrical heating plate structure of the present invention at a specified region, so as to satisfy the requirements at different sites or on different applications.

The electrical heating plate structure in accordance with the first embodiment of the present invention may be used to evaporate the water and remove the moist or mist deposited on a surface such as the windshield window of the car. In such a manner, each region of the surface of the insulating plate 10 of the electrical heating plate structure may obtain an uniform temperature distribution, thereby preventing the surface of the windshield window of the car from being cracked.

The electrical heating plate structure in accordance with the first embodiment of the present invention may also be applied on a mold, so that the mold may be maintained at an uniform temperature state.

Figure 5:
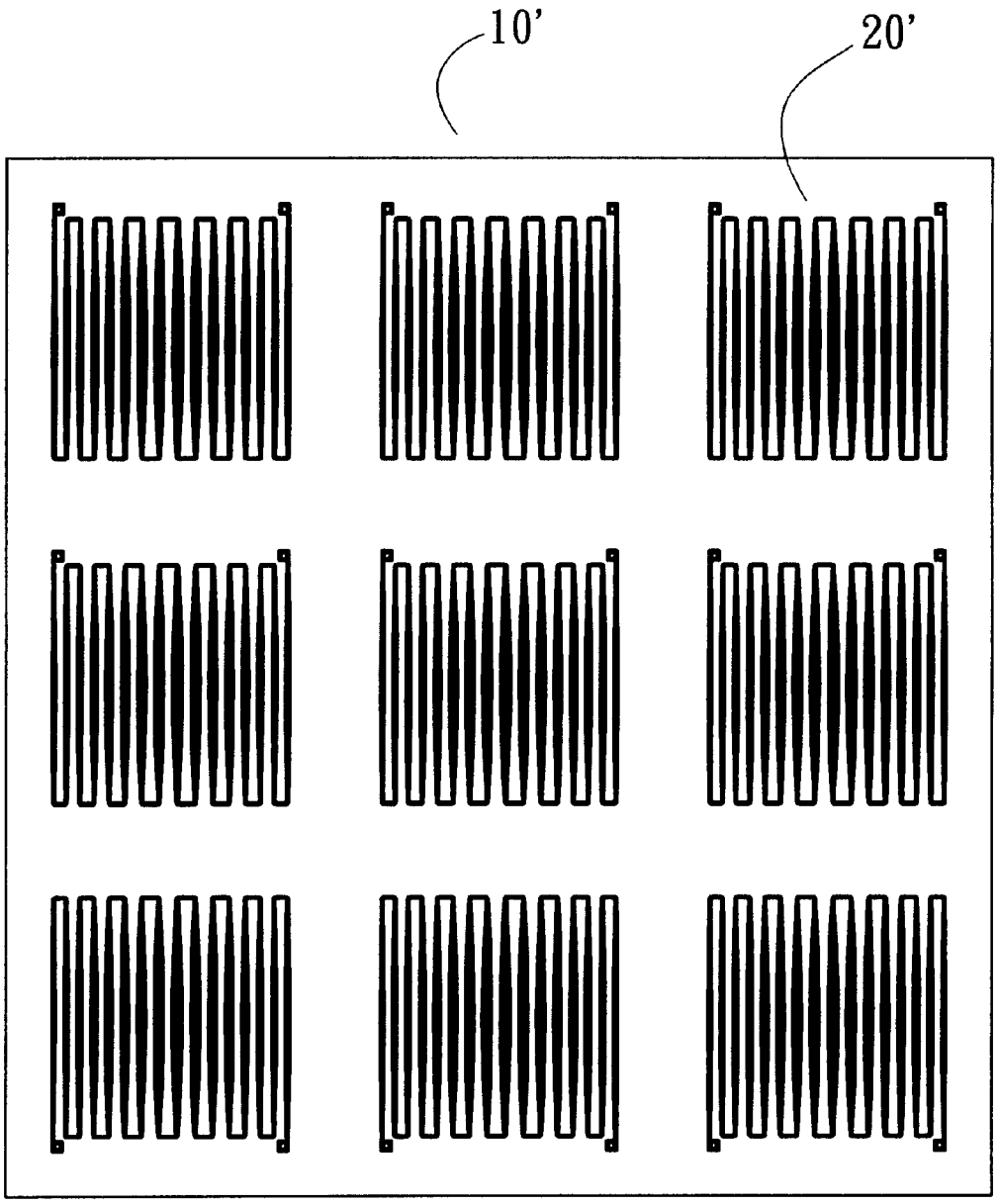
FIG. 5 is a top plan view of an electrical heating plate structure in accordance with a second embodiment of the present invention.

Referring to FIG. 5, an electrical heating plate structure in accordance with a second embodiment of the present invention comprises an insulating plate 10', and a plurality of independent electrically conducting plates 20' mounted on the insulating plate 10', thereby providing a large heating area.

Figure 6:
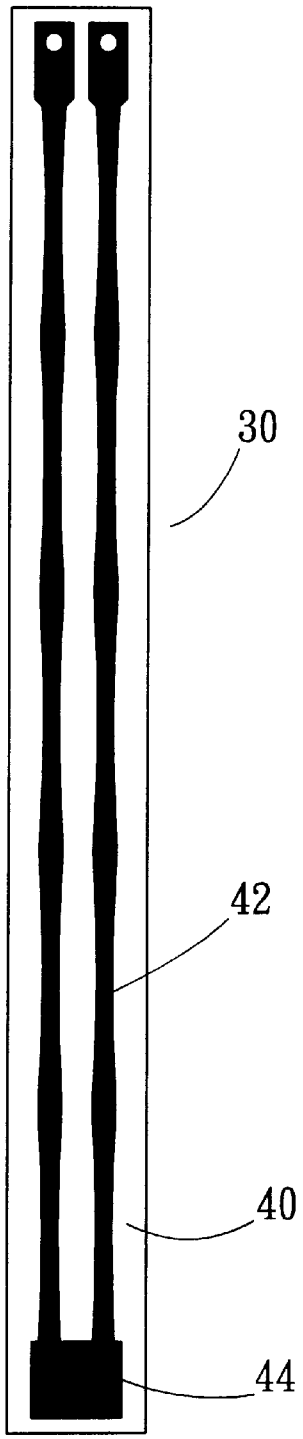
FIG. 6 is a top plan view of an electrical heating plate structure in accordance with a third embodiment of the present invention.

Referring to FIG. 6, an electrical heating plate structure in accordance with a third embodiment of the present invention comprises an insulating plate 30, and an electrically conducting plate 40 mounted on the insulating plate 30.

The electrically conducting plate 40 includes two heat emitting sections 42, and a connecting section 44 connected between the two heat emitting sections 42. The two heat emitting sections 42 are in parallel with each other, and are connected with each other in a serial manner. The radial width of each of the two heat emitting sections 42 is gradually increased and gradually decreased in a staggered manner, so that each of the two heat emitting sections 42 may have a symmetric corrugated shape. Thus, the wider zones of each of the two heat emitting sections 42 may produce a heat smaller than that produced by, the narrower zones of each of the two heat emitting sections 42, thereby capable of controlling the temperature distribution of the electrical heating plate structure of the present invention at a specified region, so as to satisfy the requirements at different sites or on different applications.

Figure 7:
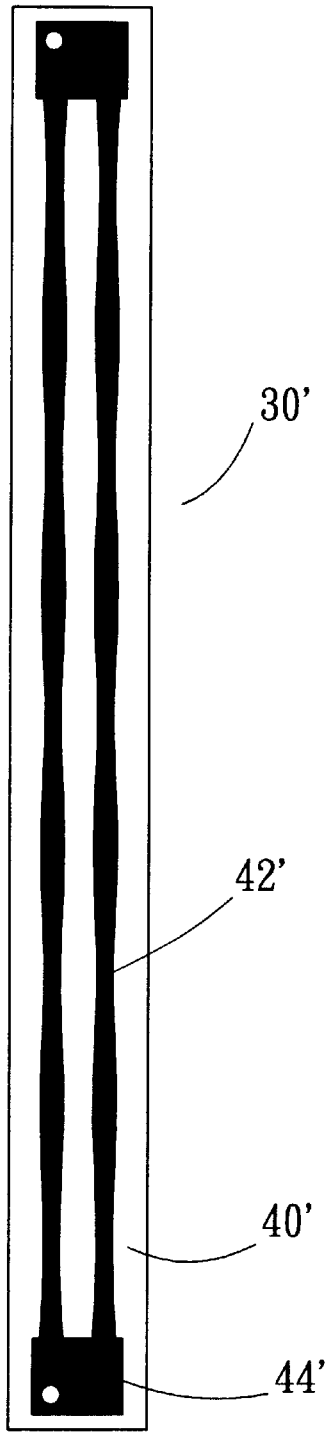
FIG. 7 is a top plan view of an electrical heating plate structure in accordance with a fourth embodiment of the present invention.

Referring to FIG. 7, an electrical heating plate structure in accordance with a fourth embodiment of the present invention comprises an insulating plate 30', and an electrically conducting plate 40' mounted on the insulating plate 30'.

The electrically conducting plate 40' includes two heat emitting sections 42', and two connecting sections 44' connected between the two heat emitting sections 42'. The two heat emitting sections 42' are in parallel with each other, and are connected with each other in a parallel manner. The radial width of each of the two heat emitting sections 42' is gradually increased and gradually decreased in a staggered manner, so that, each of the two heat emitting sections 42' may have a symmetric corrugated shape. Thus, the wider zones of each of the two heat emitting sections 42' may produce a heat smaller than that produced by the narrower zones of each of the two heat emitting sections 42', thereby capable of controlling the temperature distribution of the electrical heating plate structure of the present invention at a specified region, so as to satisfy the requirements at different sites or on different applications.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An electrical heating plate structure, comprising:

an insulating plate; and at least one electrically conducting plate mounted on the insulating plate;

wherein, the at least one electrically conducting plate includes a plurality of heat emitting sections, each of the heat emitting sections has a longitudinal length with different radial widths, the heat emitting sections have radial cross-sectional areas different from each other, thereby capable of controlling a temperature distribution of each region of the electrical heating plate structure, and the radial width of a mediate portion of each of the heat emitting sections is gradually increased from two sides of the insulating plate toward a central portion of the insulating plate.

2. The electrical heating plate structure in accordance with claim 1, wherein the radial width of each of the heat emitting sections is gradually increased from two ends of the heat emitting section toward the mediate portion of the heat emitting section.

3. The electrical heating plate structure in accordance with claim 1, wherein two sides of each of the heat emitting sections are formed with symmetric arcuate shapes.

4. The electrical heating plate structure in accordance with claim 1, wherein the electrical heating plate structure comprises a plurality of independent electrically conducting plates mounted on the insulating plate, thereby providing a large heating area.

5. The electrical heating plate structure in accordance with claim 1, wherein the radial width of each of the heat emitting sections is gradually increased and gradually decreased in a staggered manner, so that each of the two heat emitting sections may have a symmetric corrugated shape, and wider zones of each of the heat emitting sections may produce a heat smaller than that produced by narrower zones of each of the two heat emitting sections.

6. The electrical heating plate structure in accordance with claim 1, wherein the heat emitting sections are in parallel with each other, and are connected with each other in a serial manner.

7. The electrical heating plate structure in accordance with claim 1, wherein the heat emitting sections are in parallel with each other, and are connected with each other in a parallel manner.

8. The electrical heating plate structure in accordance with claim 1, wherein the heat emitting sections are connected by connecting sections.

* * * * *